United States Patent [19]

Tezuka

[11] 4,230,728

[45] Oct. 28, 1980

[54] PACKAGE FOR LAVER-WRAPPED RICE-BALL OR "ONIGIRI"

[76] Inventor: Akitomi Tezuka, 5-11 Kinuta 3-chome, Setagaya-ku, Tokyo, Japan

[21] Appl. No.: 938,349

[22] Filed: Aug. 31, 1978

[30] Foreign Application Priority Data

Sep. 30, 1977 [JP] Japan ..... 52-130740

[51] Int. Cl.[2] ..... B65D 81/32

[52] U.S. Cl. ..... 426/115; 53/461; 206/492; 229/87 F; 426/120; 426/410

[58] Field of Search ..... 426/115, 120, 119, 123, 426/106, 410; 229/56, 87 F; 206/492; 53/461

[56] References Cited

U.S. PATENT DOCUMENTS

| | | | |
|---|---|---|---|
| 618,632 | 1/1899 | Wolfersberger | 229/73 |
| 1,893,811 | 1/1933 | Ware | 426/123 |
| 1,983,685 | 12/1934 | Townsley | 426/123 X |
| 2,037,723 | 4/1936 | Heineman | 426/119 |
| 2,509,450 | 5/1950 | Reed et al. | 426/121 X |
| 2,527,919 | 10/1950 | Drangle | 426/120 |
| 2,816,838 | 12/1957 | Rose | 426/123 |
| 2,893,876 | 7/1959 | Murphy | 426/106 |
| 3,051,584 | 8/1962 | Tindall | 426/115 |
| 3,138,466 | 6/1964 | Long | 426/115 |
| 3,195,803 | 7/1965 | Ford | 229/87 F |
| 3,225,920 | 12/1965 | Reilly | 229/87 A |
| 3,730,739 | 5/1973 | Seiferth et al. | 426/119 |
| 4,143,165 | 3/1979 | Daswick | 426/115 X |
| 4,145,449 | 3/1979 | Nelham | 426/115 |

FOREIGN PATENT DOCUMENTS

| | | | |
|---|---|---|---|
| 1211659 | 11/1970 | United Kingdom | 426/123 |

*Primary Examiner*—Steven L. Weinstein

*Attorney, Agent, or Firm*—Mawhinney & Mawhinney & Connors

[57] ABSTRACT

A package for temporarily hand-packing a rice-ball of triangular shape together with a sheet of dry laver until the former is field-wrapped with the latter so as to prepare a laver-wrapped rice-ball or "Onigiri". The package includes a packing sheet of square shape folded along a fold extending through a pair of opposite angles to form a pair of folded sheets of equilateral triangular shape for holding the dry laver inbetween. The packing sheet is made of a moisture-proof material such as paraffine paper or vinyl sheet. Further inclusive is a pull-out sheet which extends from one of the vertical angle portions of the folded sheets and which is folded back toward the fold of the packing sheet. The pull-out sheet thus provided is sized to have such a sufficient margin, when the rice-ball is placed thereon for the temporary hand-packing operation, as can facilitate its hand pull-out operation at its margin before the rice-ball is wrapped with the dry laver.

5 Claims, 7 Drawing Figures

PACKAGE FOR LAVER-WRAPPED RICE-BALL OR "ONIGIRI"

BACKGROUND OF THE INVENTION

1. Field of the Invention

The present invention relates to a package for a rice-ball wrapped with dry laver, and more particularly to a package for temporarily hand-packing a rice-ball of triangular shape together with a sheet of dry laver until the former is wrapped with the latter.

2. Description of the Prior Art

For portable lunch, rice is often made into a ball which is wrapped with dry laver. This laver-wrapped rice-ball is very popular food in Japan and is called "Onigiri", "Omusubi" or "Sushi". Although the laver is dried at first, it gradually gets moist after it is wrapped around the rice-ball, because it is in direct contact with the ball. After the laver gets moist, its flavor is so deteriorated while losing its intrinsic crisp feeling that its eater loses his appetite.

SUMMARY OF THE INVENTION

It is, therefore, a major object of the present invention to provide a package for temporarily hand-packing a rice ball together with dry laver in an insulated manner until the former is wrapped with the latter.

Another object of the present invention is to provide a package of the above type, by which the laver wrapping operation can be accomplished by ones own hands without any direct touch upon the rice-ball nor the laver thereby to improve convenience and sanitation, and to enjoy oneself.

BRIEF DESCRIPTION OF THE DRAWING

Other objects and advantages of the present invention will become apparent from the following description taken in conjunction with the accompanying drawing, in which.

DESCRIPTION OF THE PREFERRED EMBODIMENTS

Figure 1:
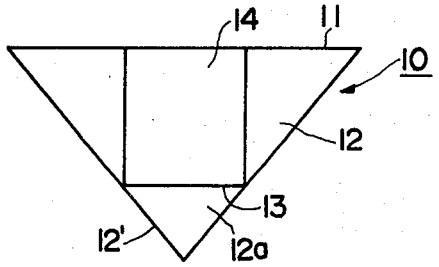
FIG. 1 is a top plan view showing a package exemplifying the present invention.

Indicated at reference numeral 10 is a package which exemplifies the present invention. A packing sheet of square shape is prepared and is folded along a fold 11 extending through a pair of opposite angles so as to form a pair of folded sheets 12 and 12' which have the shape of an equilateral triangle. The packing sheet thus folded may preferably be made of a water- or moisture-proof material such as paraffine paper or vinyl sheet. One of the folded sheets or the folded sheet 12 of this side has its vertical angle portion **12*a* removed at line 13. A pull-out sheet 14 is provided to extend from the line 13 and is folded back toward the fold 11**.

Figure 2:
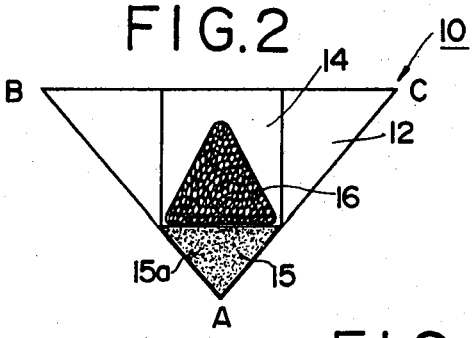
FIG. 2 is similar to FIG. 1 but shows the condition, under which a sheet of dry laver is inserted into the package and under which a rice-ball is placed on a pull-out sheet.
Figure 3:
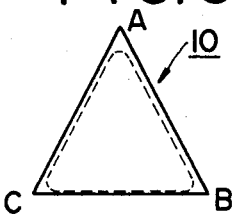
FIG. 3 is similar to FIGS. 1 and 2 but shows the condition, under which the rice-ball is temporarily hand-packed with the package together with the dry laver.

When the package 10 of the invention is to be used, a sheet of dry laver 15 having a similarly right-angled equilateral triangular shape is inserted and held between the folded sheets 12 and 12', as better seen from FIG. 2, while leaving its portion **15*a* exposed to the outside. Then, a rice-ball 16 which is prepared to have a triangular shape is placed upon the pull-out sheet 14 in a manner to have its base aligned substantially with the line 13. As shown, the pull-out sheet 14 may preferably be sized to have such a sufficient margin as can facilitate its manual pull-out operation even when the rice-ball 16 is placed thereon. Then, the vertexes A, B and C of the folded sheets 12 and 12' are folded round the rice-ball 16 together with the dry laver 15 thereby to finish the temporary hand-packing of the rice-ball 16, as seen from FIG. 3**.

Figure 4:
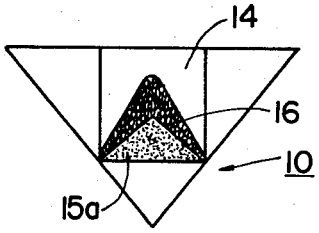
FIG. 4 is similar to FIGS. 1 to 3 but shows the condition, under which the package is opened or unpacked.
Figure 5:
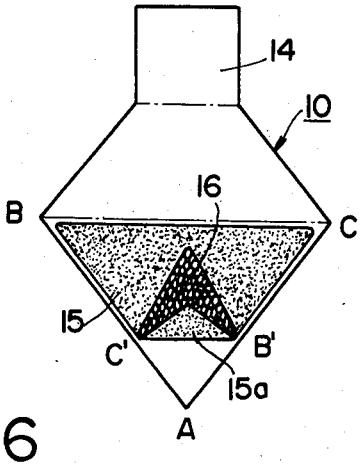
FIG. 5 is similar to FIGS. 1 to 4 but shows the condition, under which the pull-out sheet is pulled out to expand or unfold the package before the rice-ball is field-wrapped with the laver.

For eating purpose, the package 10 is opened or unpacked into the condition,. as shown in FIG. 4, under which the laver portion **15*a* has sticked to the rice-ball 16. Then, the pull-out sheet 14 is pulled out to expand or unfold the package 10 while leaving the rice-ball 15 seated as it is on the center of the laver 15 which has been kept dry, as seen from FIG. 5. After that, the vertexes B and C are folded to the opposite vertexes B' and C' of the rice-ball 16** in an alternate manner so as to finish the wrapping.

As has been described hereinbefore, according to the present invention, a rice-ball can be hand-packed together with a sheet of dry laver easily in an insulated manner. For eating purposes, moreover, the rice-ball can be wrapped with the laver, which is kept substantially dry, easily with minimum direct touch. With the use of such package, still moreover, the packing and wrapping operations can be accomplished with joy especially for a picnic or the like.

Figure 6:
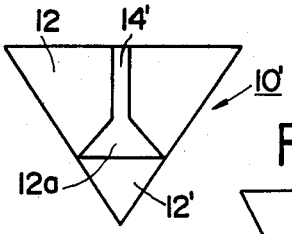
FIG. 6 is similar to FIG. 1 but shows another embodiment of the present invention.

Turning now to FIG. 6, there is shown another embodiment 10' of the present invention, in which the vertical angle portion **12*a* of the folded sheet 12 of this side is folded back without removing the vertical angle area 12*a*. Thus, a pull-out strip 14' is provided to extend from that portion 12*a*. In this second embodiment, the pull-out strip 14'** is so long that it can also facilitate its manual pull-out operation.

Figure 7:
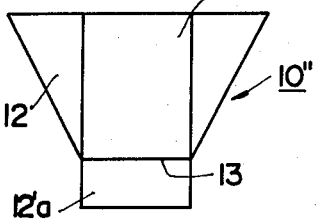
FIG. 7 is similar to FIGS. 1 and 6 but shows a further embodiment of the present invention.

If the vertical angle portion **12*a'* of the back side folded sheet 12' is extended with the same width as the length of the line 13, as seen from FIG. 7, it is advantageous that the temporary packing of the laver can be accomplished more completely, because the fin-shaped portion 12*a'* can cover the both corners of the rice-ball 16** which might otherwise be left uncovered.

Although the foregoing description has been limited to the rice-ball, it should be noted that the package of the present invention can also be used to pack bread and butter.

What is claimed is:

1. A packing sheet for temporarily hand-packing and completely enclosing a rice-ball of generally triangular shape together with a sheet of dry laver of generally equilateral triangular shape while substantially isolating the former from the latter to protect the latter against moisture until the former is wrapped with the latter, comprising:

a moisture-proof packing sheet of generally diamond shape folded along a fold extending through a pair of opposite angles to form a pair of folded sheets of generally equilateral triangular shape with the dry laver contained in between;

a pull-out sheet extending from the top one of the unfolded angle portions of one of said folded sheets and folded back toward the fold of said packing sheet, said rice ball being positioned on said pull-out sheet and said pull-out sheet extending a sufficient margin from beneath and beyond said rice ball, to facilitate its manual pull out when the packing sheet is unfolded said rice ball being substantially separated from said dry laver;

the folded back pull-out sheet exposing a portion of the laver contained between said pair of folded sheets; the folded and unfolded angle portions being further folded together with edges of each of said angle portions overlapping each other so that the exposed portion of laver is also folded and sticks to a portion of the rice ball to facilitate a separation of said pull-out sheet from said rice ball to position said rice ball directly on said dry laver upon unfolding said packing sheet prior to consumption.

2. A packing sheet according to claim 1, wherein said packing sheet has a generally square shape and the triangular shape of the dry laver is right-angled.

3. A packing sheet according to claim 1, wherein said moisture-proof material is paraffine paper.

4. A packing sheet according to claim 1, wherein said pull-out sheet has a generally rectangular shape extending from its fold.

5. A packing sheet according to claim 1, wherein said pull-out sheet includes a strip extending to the fold of said packing sheet.

* * * * *